US007890023B2

(12) United States Patent
Jeon et al.

(10) Patent No.: US 7,890,023 B2
(45) Date of Patent: Feb. 15, 2011

(54) IMAGE FORMING APPARATUS

(75) Inventors: Sang-uk Jeon, Yongin-si (KR); Sung-won Kim, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 263 days.

(21) Appl. No.: 12/041,794

(22) Filed: Mar. 4, 2008

(65) Prior Publication Data

US 2008/0226343 A1 Sep. 18, 2008

(30) Foreign Application Priority Data

Mar. 15, 2007 (KR) ..... 10-2007-0025286
Mar. 15, 2007 (KR) ..... 10-2007-0025435

(51) Int. Cl.
*G03G 15/16* (2006.01)
*G03G 21/00* (2006.01)
*G03G 15/20* (2006.01)

(52) U.S. Cl. ..... 399/122; 399/124; 399/320

(58) Field of Classification Search ..... 399/122, 399/124, 320, 400
See application file for complete search history.

(56) References Cited

U.S. PATENT DOCUMENTS 4,384,781 A 5/1983 Takada
4,965,640 A * 10/1990 Watarai et al. ..... 399/122
5,206,682 A 4/1993 Yamada et al.
5,991,572 A * 11/1999 Cho ..... 399/122
6,549,740 B2 * 4/2003 Yoneda et al. ..... 399/122
7,574,158 B2 * 8/2009 Uehara ..... 399/122
2004/0052548 A1 * 3/2004 Shimizu et al. ..... 399/122
2005/0089352 A1 * 4/2005 Lee et al. ..... 399/322

(Continued)

FOREIGN PATENT DOCUMENTS

EP 0 919 885 6/1999

(Continued)

OTHER PUBLICATIONS

European Search Report dated Nov. 27, 2008 issued in EP 08101737.8.
European Search Report dated Aug. 5, 2008 issued in EP 08101737.8.

*Primary Examiner*—David M Gray
*Assistant Examiner*—Francis Gray
(74) *Attorney, Agent, or Firm*—Stanzione & Kim LLP

(57) ABSTRACT

An image forming apparatus to remove a jammed printing medium and to prevent a transmission of fixing heat is provided. The image forming apparatus includes a fixing unit to fix a toner image into a printing medium when the toner image is transferred onto the printing medium, the fixing unit including a fixing frame on which a pair of fixing rollers are rotatably disposed, at least one discharge roller disposed on the fixing frame, and a discharge guide movable with respect to the fixing frame, and having a plurality of guide protrusions to guide the printing medium toward the discharge roller when the printing medium passes through the fixing unit. The fixing unit additionally includes a cover to cover the discharge roller and the discharge guide, and a plurality of heat dissipating ribs extending from an outer surface of the cover. The heat dissipating ribs have a height and are arranged at a gap from each other so as to prevent a user's hand from directly contacting the cover.

23 Claims, 10 Drawing Sheets

U.S. PATENT DOCUMENTS

| | | | | |
|---|---|---|---|---|
| 2006/0008294 | A1* | 1/2006 | Ito et al. | 399/122 |
| 2007/0196127 | A1 | 8/2007 | Kubo et al. | |
| 2008/0219733 | A1* | 9/2008 | Ito | 399/400 |

FOREIGN PATENT DOCUMENTS

| | | |
|---|---|---|
| EP | 0 953 885 | 11/1999 |
| EP | 1 099 987 | 5/2001 |
| EP | 1 619 563 | 1/2006 |
| JP | 2003-241615 | 8/2003 |

* cited by examiner

IMAGE FORMING APPARATUS

CROSS-REFERENCE TO RELATED APPLICATIONS

This application claims priority under 35 U.S.C. §119(a) of Korean Patent Application No. 10-2007-0025435, filed on Mar. 15, 2007, and Korean Patent Application No. 10-2007-0025286, filed on Mar. 15, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus to form an image onto a printing medium.

2. Description of the Related Art

Generally, a convergence type image forming apparatus such as a multi-function unit incorporating functions of a printer, a copier or a facsimile, has a main function of printing an image onto a printing medium. The image forming apparatus includes a feeding unit to feed a printing medium, an image forming unit to form an image, a transfer unit to transfer the image onto printing medium, a fixing unit to fix the image into the printing medium, and a discharge unit to discharge the printing medium to an outside thereof after the printing. FIG. 1 illustrates examples of a fixing unit 40 and a discharge unit 50 of a conventional image forming apparatus.

Referring to FIG. 1, the fixing unit 40 of the conventional image forming apparatus includes a heating roller 41 and a pressing roller 42 rotated in tight contact with each other. The discharge unit 50 includes a discharge roller 51 provided at an exit side of a printing medium passing between the heating and pressing rollers 41 and 42, and an idle roller 53 to rotate in tight contact with the discharge roller 51.

The heating and pressing rollers 41, 42 are rotatably supported on a frame 43, and the discharge roller 51 is disposed on a discharge guide 52 which is pivotable about the frame 43. The idle roller 53 is mounted on the frame 43 at a position facing the discharge roller 51. A plurality of rotatable guide protrusions 54 are formed on the frame 43, in proximity to the heating roller 41, to guide the printing medium being discharged. The rotatable guide protrusions 54 are elastically supported by elastic springs (not shown), so that when rotated, the rotatable guide protrusions 54 are elastically biased towards the original position.

An unsuccessful conveyance of the printing medium, such as jamming, occurs during an image fixing process. In this case, a user controls the discharge guide 52 to pivot and move away from the frame 43 to expose the heating and pressing rollers 41 and 42 to an outside thereof, so as to remove the jammed printing medium.

The jammed printing paper is caught at the guide protrusions 54 nearby the heating roller 41, and torn apart. The elastic springs supporting the guide protrusions 54 are deformed or displaced from an original position, by an excessive force exerted by the user to remove the printing medium.

Meanwhile, the fixing unit 40 generates heat of approximately 200° C. in the fixing process. As the heat is transmitted to an upper cover (not illustrated) that forms the outer side of the fixing unit 40, to cause damages, such as changed color, or deformation. In addition, user access is limited when the upper cover is heated.

The heat from the fixing unit 40 is also radiated to the neighboring components stacked at an upper portion of the image forming apparatus such as scanning unit, to cause malfunction or operation failure of the affected components.

SUMMARY OF THE INVENTION

The present general inventive concept provides an image forming apparatus, which enables easy removal of a jammed printing medium therefrom.

The present general inventive concept also provides an image forming apparatus having an improved structure, which is capable of preventing malfunction or damages of components due to a fixing heat, and increasing user safety.

Additional aspects and utilities of the present general inventive concept will be set forth in part in the description which follows and, in part, will be obvious from the description, or may be learned by practice of the general inventive concept.

The foregoing and/or other aspects and advantages of the present general inventive concept may be achieved by providing an image forming apparatus which includes a fixing unit to fix a toner image into a printing medium when the toner image is transferred onto the printing medium, the fixing unit including a fixing frame on which a pair of fixing rollers are rotatably disposed, at least one discharge roller disposed on the fixing frame, and a discharge guide movable with respect to the fixing frame, the discharge guide having a plurality of guide protrusions to guide the printing medium towards the discharge roller when the printing medium passes through the fixing unit.

The discharge guide may be movable between an opening and closing position to open and close a discharge path of the printing medium at the opening position and at the closing position, respectively.

The discharge guide may be pivotably opened with respect to the fixing frame.

An elastic element may be provided to elastically bias the guide protrusions towards the fixing roller.

Stoppers may be disposed on the discharge guide at locations corresponding to the guide protrusions to restraint a returning force of the elastic element.

At least one idle roller may be disposed on the discharge guide to rotate in contact with the discharge roller at the closing position.

A plurality of conveyance ribs may be formed on a rear surface of the discharge guide to face the pair of fixing rollers.

A locking unit may additionally be provided to selectively lock the discharge guide with respect to the fixing frame.

The locking unit may include a locking protrusion disposed on the discharge guide, and having a gradient to be movable between a locking position and an unlocking position, a hook disposed on the fixing frame and having a gradient to correspond to the gradient of the locking protrusions such that the locking protrusion at the locking position is engaged with the hook, and a locking spring to elastically bias the locking protrusion towards the locking position.

The locking unit may include a movable protrusion integrally extending from the locking protrusion, and a locking rail to receive the movable protrusion to guide the movement of the movable protrusion.

The fixing unit may further include a cover to cover the at least one discharge roller and the discharge guide, and a plurality of heat dissipating ribs extending from an outer surface of the cover, wherein the plurality of heat dissipating ribs have a height of 1.0 mm or more and a gap of 10 mm or less to prevent a user's hand from directly contacting the cover.

The foregoing and/or other aspects and advantages of the present general inventive concept may be achieved by providing an image forming apparatus comprising a discharge guide formed on a fixing unit that fixes a visible image into a printing medium with a heat to guide conveyance of the printing medium, which may include a discharge guide body, a hinge formed on one side of the discharge guide body as a pivot of rotation, and a handgrip portion formed approximately on a center of an opposite side to the side where the hinge is formed for a grip of a user, wherein the discharge guide body has different a heat conductivity between a proximity to the handgrip portion and other areas.

The foregoing and/or other aspects and advantages of the present general inventive concept may be achieved by providing an image forming apparatus, which may include a fixing unit to fix a transferred image into a printing medium, a discharge guide movably disposed on the fixing unit to cover the fixing unit, and having a plurality of guide protrusions to guide the printing medium, toward a discharge roller, a cover to cover the fixing unit and the discharge guide, and a plurality of heat dissipating ribs extending from an outer surface of the cover to a height and arranged at a gap from each other to block a user's hand from directly contacting the cover.

The height of the heat dissipating ribs is 1.00 mm or more, and the gap heat dissipating ribs is 10 mm or less.

The fixing unit may include a pair of fixing rollers to generate a fixing heat, and a fixing frame to support the pair of fixing rollers and the discharge roller, wherein the cover is disposed on the fixing frame to cover the proximity to one of the pair of fixing rollers that generates the fixing heat.

The fixing frame and the cover may be distanced away from each other by a space to prevent a heat transmission.

The image forming apparatus may include a handgrip portion made out of a material having a different heat conductivity from the discharge guide and formed approximately at a center of a side opposite to the hinge.

BRIEF DESCRIPTION OF THE DRAWINGS

These and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1:
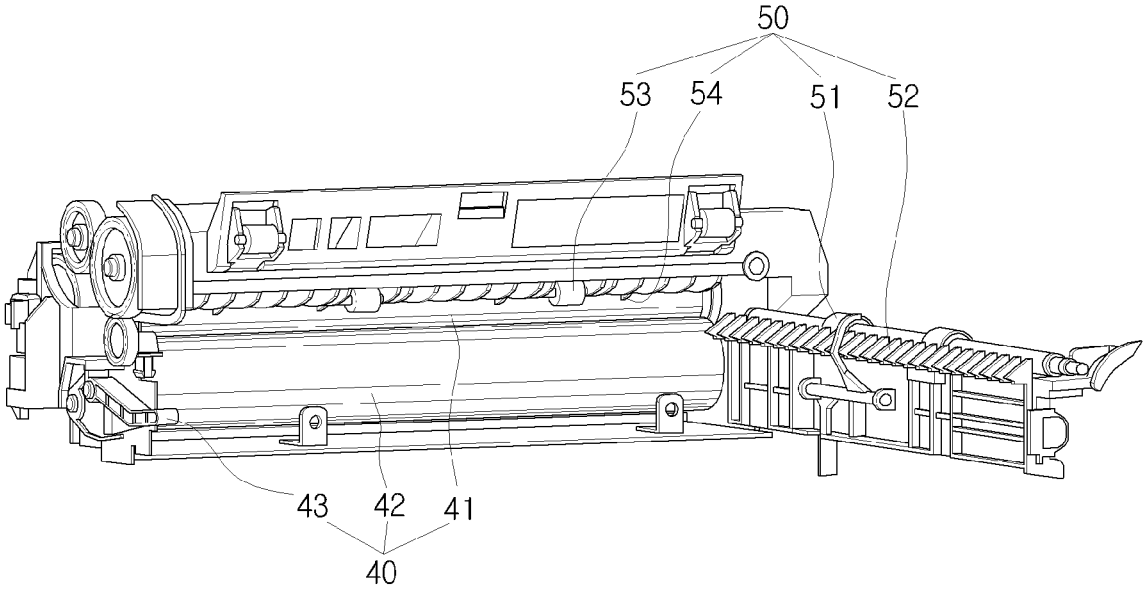
FIG. 1 (PRIOR ART)
FIG. 1 is a perspective view illustrating a fixing unit and a discharge unit of a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
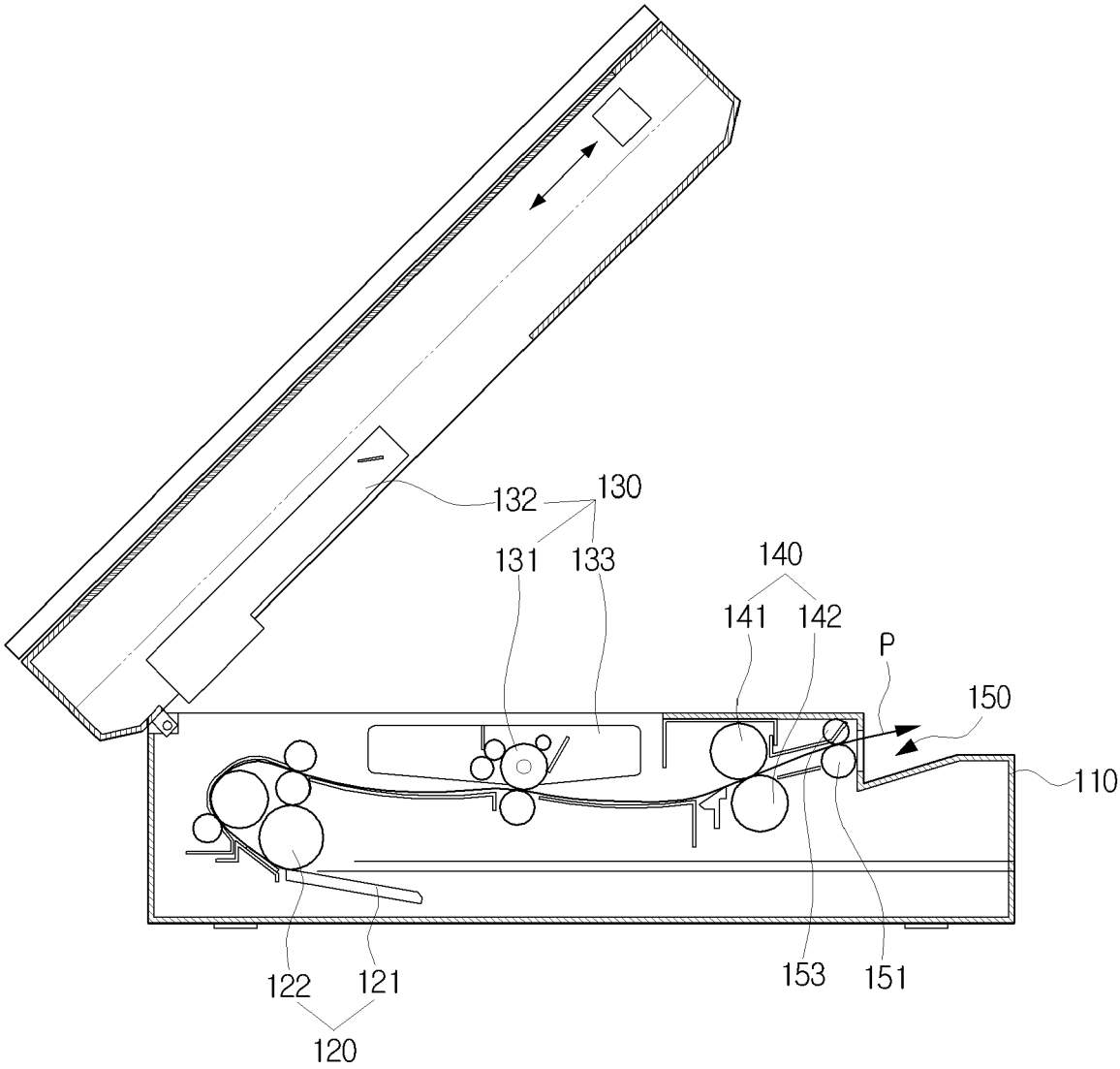
FIG. 2 is a view illustrating an image forming apparatus according to a first exemplary embodiment of the present general inventive concept.

Referring to FIG. 2, an image forming apparatus according to a first exemplary embodiment of the present general inventive concept includes a main body 110, a fixing unit 140 and a discharge unit 150.

The main body 110 houses therein a feeding unit 120 to feed printing media P, and an image forming unit 130 to form an image to be printed onto a printing medium P fed from the feeding unit 120.

The feeding unit 120 includes a feeding cassette 121 to hold the printing media P therein, and a pickup roller 122 to pick up the printing media P from the feeding cassette 120 sheet by sheet.

The image forming unit 130 includes a photosensitive medium 131 such that an electrostatic latent image is formed on the photosensitive medium by an exposure unit 132, and a developing unit 133 to visualize the electrostatic latent image on the photosensitive medium 131.

The feeding unit 120 and the image forming unit 130 are constructed in a generally-known manner, so the detailed description thereof will be omitted for the sake of brevity.

Figure 3:
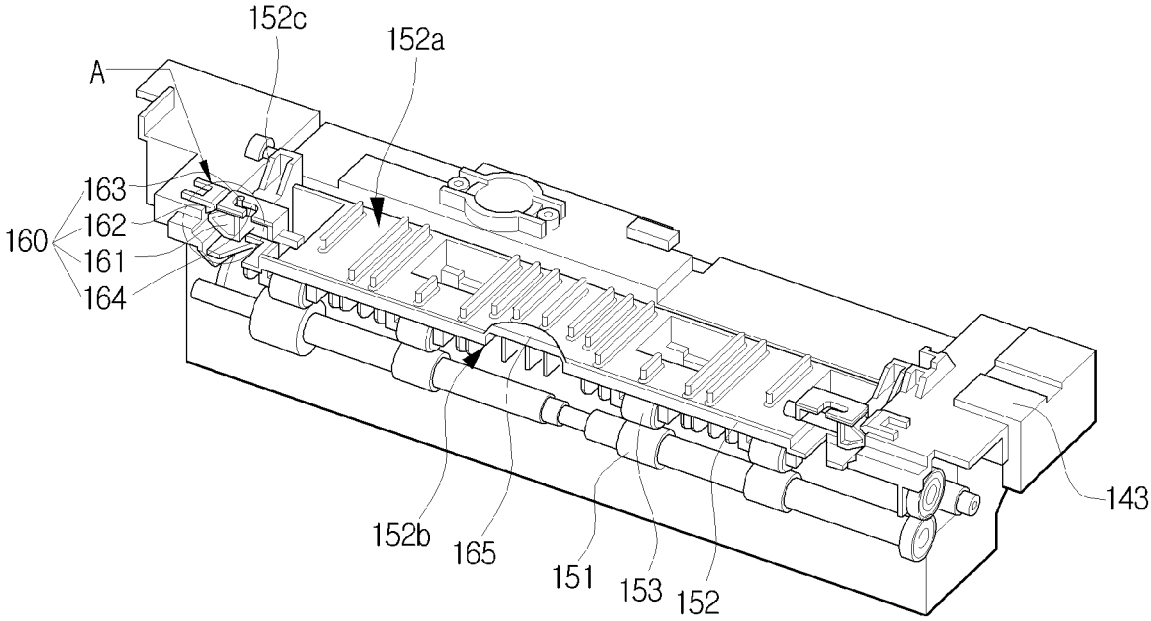
FIG. 3 is a perspective view illustrating a fixing unit and a discharge unit of the image forming apparatus of FIG. 2.
Figure 4:
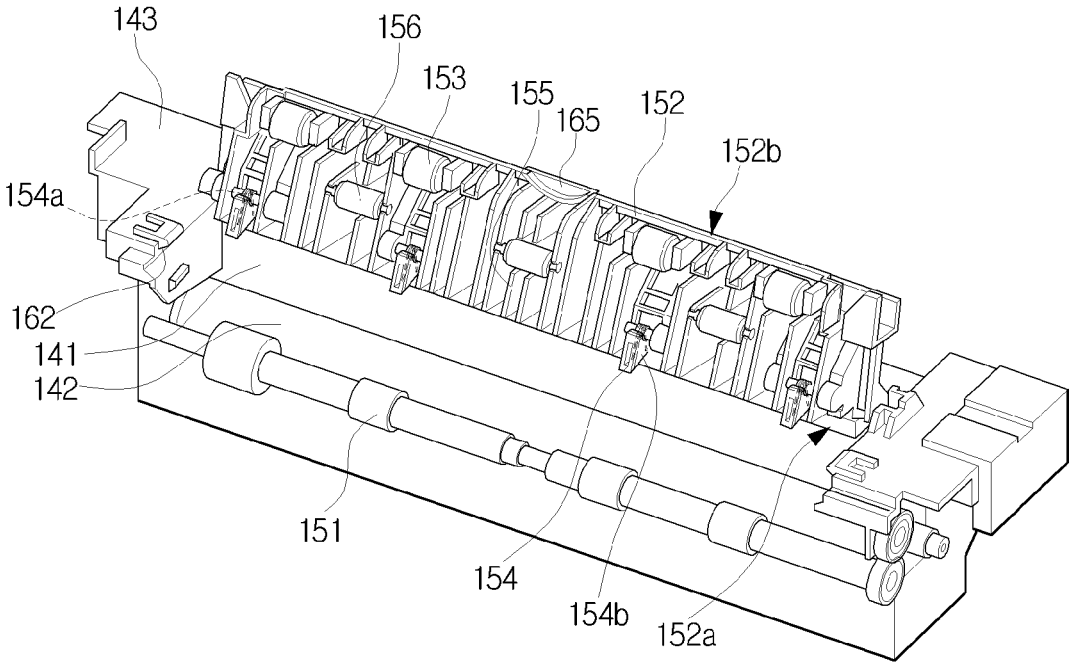
FIG. 4 is a perspective view illustrating a discharge guide of FIG. 3 in an open state.

Referring to FIGS. 2, 3 and 4, the fixing unit 140 operates to fix the toner image onto the printing medium P after the image is formed by the image forming unit 130 and transferred onto the printing medium P. The fixing unit 140 includes a heating roller 141, a pressing roller 142, and a fixing frame 143.

The heating roller 141 includes a heating source (not illustrated) to heat the printing medium P with a predetermined fixing temperature. Heating elements such as a halogen lamp or a heating coil may be implemented as the heating source of the heating roller 141.

The pressing roller 142 presses the printing medium P with a predetermined pressure against the heating roller 141. Accordingly, the printing medium P passing between the heating and pressing rollers 141 and 142 is pressed against the heating roller 141. One or more ends of the pressing roller 142 are elastically supported by springs (not illustrated) which are disposed on the fixing frame 143.

The fixing frame 143 supports the heating and pressing rollers 141 and 142 in a rotatable manner. The fixing frame 143 may be formed of a thermally endurable material so that the fixing frame 143 is not affected by the high temperature heat radiating from the heating roller 141.

A force transmitting element (not illustrated) may be provided on the fixing frame 143 to transfer the driving force of a driving source (not illustrated) to drive the heating and pressing rollers 141 and 142.

Referring to FIG. 4, the discharge unit 150 may include a discharge roller 151, a discharge guide 152, and an idle roller 153.

The discharge roller 151 is rotatably disposed on the fixing frame 143 to discharge the printing medium P to an outside thereof.

The discharge guide 152 operates to guide the printing medium P being discharged. The discharge guide 152 pivots to be open about the fixing frame 143. In particular, the discharge guide 152 is movable between an open position (FIG. 4) and a closing position (FIG. 3), such that a path of the printing medium P, having passed through the heating and pressing rollers 141 and 142, is open at the open position, and closed at the closing position.

Figure 5:
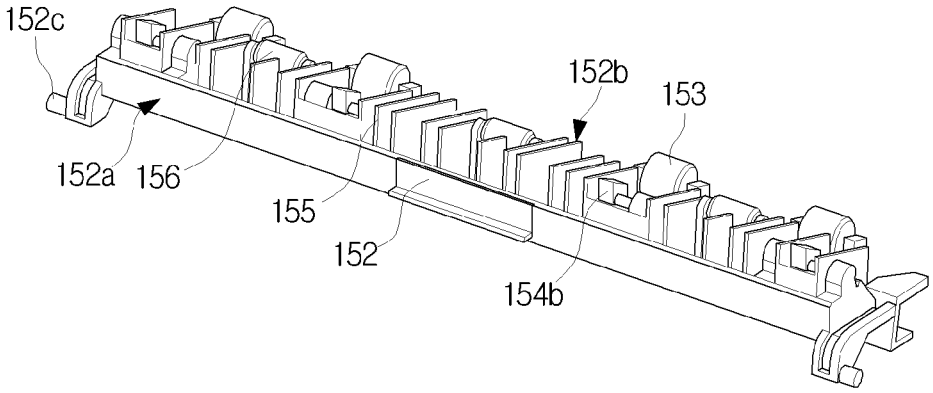
FIG. 5 is a rear perspective view illustrating the discharge guide of FIG. 4.

With reference to FIGS. 3 through 5, the discharge guide 152 includes a supported end 152*a* connected with the fixing frame 143, and a free end 152*b* to rotate about the supported end 152*a*. The discharge guide 152 is hingedly coupled to the fixing frame 143, that is, the discharge guide 152 is hinged about a hinge shaft 152*c* formed on the supported end 152*a*.

The above example is only for the illustrative purpose, so other adequate alternative examples are also possible. For example, one alternative implementation may form a rail in the fixing frame 143 to receive the hinge shaft 152*c* of the discharge guide 152, enabling the discharge guide 152 to slide along the rail and rotate with respect to the fixing frame 143.

A plurality of conveyance ribs 155 are formed on a rear surface of the discharge guide 152, to guide the printing medium P. The rear surface of the discharge guide 152 faces the discharge path of the printing medium P, and may face the heating and pressing rollers 141 and 142. A plurality of secondary conveyance rollers 156 may be formed between the plurality of conveyance ribs 155 to facilitate the conveyance of the printing medium P.

The discharge guide 152 may include a plurality of guide protrusions 154 to guide the printing medium P from the fixing unit 140 towards the discharge roller 151. In particular, the guide protrusions 154 are formed on the supported end 152*a* of the discharge guide 152, in the proximity to the heating roller 141, to guide the leading edge of the printing medium P, having past between the heating and pressing rollers 141, 142, towards the discharge roller 151.

The guide protrusions 154 are rotatably disposed on the discharge guide 152, and elastically biased by the support of an elastic member 154*a* toward the discharge path of the printing medium P, that is, toward the heating and pressing rollers 141 and 142. Because the guide protrusions 154 are rotatable on the discharge guide 152, a user may rotate the guide protrusions 154 to open with ease when it is necessary to repair the guide protrusions 154 or remove a foreign substance or a jammed printing medium from the guide protrusions 154. The elastic member 154*a* may be a torsion spring. The elastic member 154*a* may support a rear surface of the guide protrusions 154.

Meanwhile, referring to FIGS. 4 and 5, the guide protrusions 154 are rotated within a range that is limited by stoppers 154*a* at locations corresponding to the guide protrusions 154 of the discharge guide 152. The stoppers 154*a* restraint a returning force of the elastic member 154*a*. That is, the stoppers 154*a* restrain the force that brings the guide protrusions 154 into tight contact with the heating roller 141. Because the guide protrusions 154 are controlled not to interfere with a surface of the heating roller 141, damage on the surface of the heating roller 141 due to the guide protrusions 154 can be prevented.

Figure 6A:
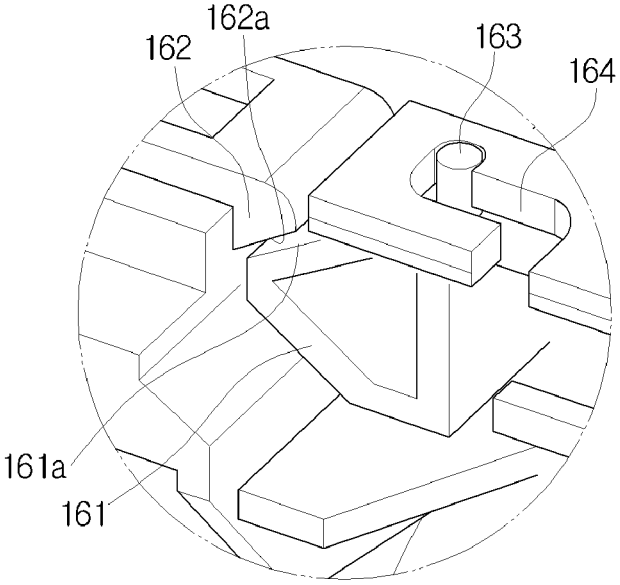
FIGS. 6A and 6B are perspective views illustrating area A of FIG. 3 in enlargement to illustrate the operational status of a locking unit.
Figure 6B:
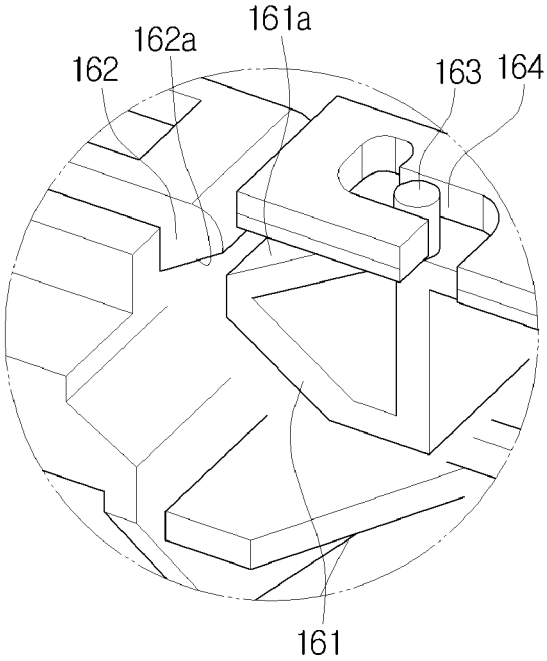
Figure 7:
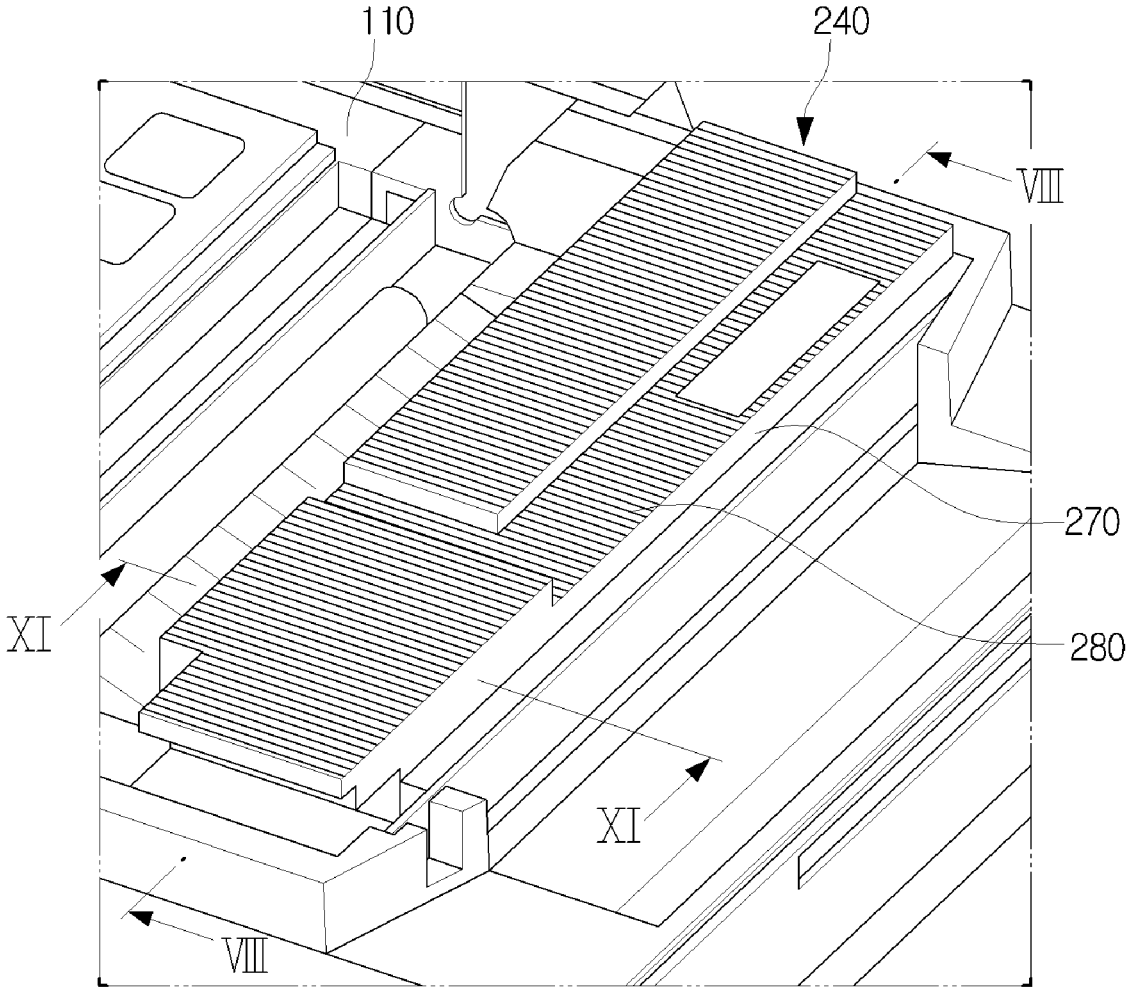
FIG. 7 is a perspective view illustrating an image forming apparatus according to a second exemplary embodiment of the present general inventive concept.
Figure 8:
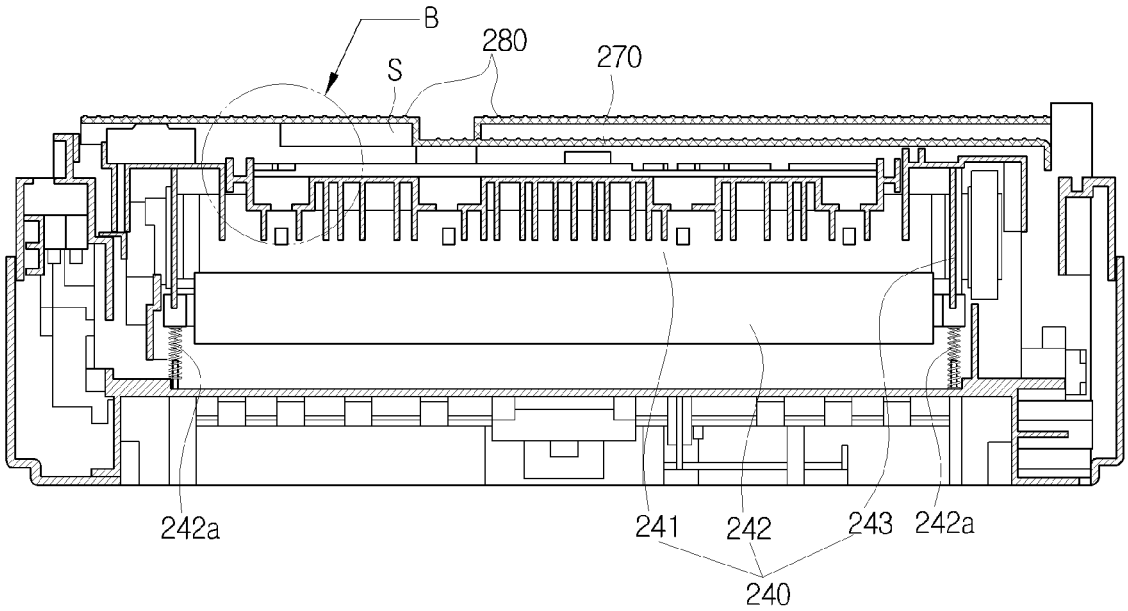
FIG. 8 is a cross section view taken on line VIII-VIII of FIG. 7.

Referring to FIGS. 3 and 6, the discharge guide 152 as constructed above is selectively locked or unlocked with respect to the fixing frame 143 by a locking unit 160. The locking unit 160 includes a locking protrusion 161, a hook 162, a movable protrusion 163, and a locking rail 164.

The locking protrusion 161 extends on the sub frame 143*b* from the discharge guide 152. The locking protrusion 161 includes a gradient 161*a* formed on a distal end thereof. The locking protrusion 161 is movable between a locking position and an unlocking position.

Although not illustrated, a locking spring may be additionally provided, to elastically support the locking protrusion 161 such that the locking protrusion 161 at the unlocking position is returned to the locking position.

The hook 162 is formed on the main frame 143*a* at a location to correspond to the locking protrusion 161. The hook 162 may also include a gradient 162*a* formed on a distal end thereof to correspond to the gradient 161*a* of the locking protrusion 161. Accordingly, when the locking protrusion 161 is moved to the locking or unlocking position, the gradient 161*a* of the locking protrusion 161 is slidably guided along the gradient 162*a* of the hook 162, and the locking protrusion 161 is inserted in or separated from the hook 162.

The movable protrusion 163 may be formed integrally with the locking protrusion 161. The movable protrusion 163 is inserted in the locking rail 164. The locking rail 164 guides the movable protrusion 163 between locking and unlocking positions, and also guides the locking protrusion 161 to move within a predetermined range.

By the construction explained above, the locking unit 160 is moved to the unlocking position, in response to the user rotating the discharge guide 152 to the open position. As a result, the user may remove a jammed printing medium P with ease from the discharge path or at least one of the fixing unit 140 and the discharge unit 150.

More specifically, by the force of the user rotating the locking protrusion 161 of the discharge guide 152 to the open position, the locking protrusion 161 is slidably guided along the gradient 162*a* of the hook 162 and moved to the unlocking position where the locking protrusion 161 is separated away from the hook 162.

Conversely, by the force of the user moving the discharge guide 152 to the closing position, the gradient 161*a* of the locking protrusion 161 is slidably guided along the gradient 162*a* of the hook 162, and moved to the unlocking position where the locking protrusion 161 is inserted in the hook 162. In this situation, the locking spring (not illustrated) presses the locking protrusion 161 towards the locking position, and the movement of the movable protrusion 163, which has been guided along the locking rail 164 to the locking protrusion 161, is controlled within a limited range.

Referring to FIGS. 3 and 4, a handgrip portion 165 may be formed on the discharge guide 152 of the sub frame 143*b*, for convenience of user in rotating the discharge guide 152.

The handgrip portion 165 may be made out of a material that has different heat-conductivity than the discharge guide 152 of the sub frame 143*b* so that the handgrip portion 165 can protect a user from the fixing heat of the fixing unit 140.

The idle roller 153 is formed on the discharge guide 152 of the sub frame 143*b* in a manner such that the idle roller 153 faces the discharge roller 151 when the discharge guide 152 is at the closing position. In particular, the idle roller 153 is formed on the free end 152*b* of the discharge guide 152. As a result, the idle roller 153 is rotated together with the discharge roller 151 by the driving force of the discharge roller 151, such that the printing medium P bearing the fixed image is passed between the idle roller 153 and the discharge roller 151 and discharged out.

An operation of removing a jammed printing medium P from an image forming apparatus according to an embodiment of the present general inventive concept will be explained below with reference to FIGS. 2 through 5.

Referring to FIG. 2, a printing medium P is fed from the feeding unit 120, and an image is formed as the printing medium P is passed through the image forming unit 130. The image is fixed into the printing medium P as the printing medium P passes between the heating and pressing rollers 141, 142 of the fixing unit 140.

The printing medium P bearing the fixed image is guided by the guide protrusions 154 of the discharge guide 152 at the leading edge thereof, conveyed by the conveyance ribs 155 and the secondary conveyance rollers 156, and entered between the discharge roller 151 and the idle roller 153 of the discharge unit 150. The printing medium P, having past between the discharge roller 151 and the idle roller 153, is discharged out of the main body 110 of the image forming apparatus.

If a printing medium P is jammed, a user grabs the handgrip portion 165 and rotates the sub frame 143*b* having the discharge guide 152 to the open position to open the paper discharge path. According to the rotating force of the discharge guide 152, the locking protrusion 161 of the locking unit 160 slides along the gradient 162*a* of the hook 162 to be separated from the hook 162 and moved to the unlocking position.

Referring to FIG. 4, because the guide protrusions 154 are spaced away from the heating and pressing rollers 141 and 142 by a gap wide enough, the user removes the jammed printing medium P without having interference with the guide protrusions 154 through an open gap between the main frame 143*a* and the sub frame 143*b*.

Referring to FIGS. 7 to 10, an image forming apparatus according to a second exemplary embodiment of the present general inventive concept will be explained below.

An image forming apparatus according to the second exemplary embodiment of the present invention may include a main body 110, a fixing unit 240, a cover 270, and heat dissipating ribs 280.

The fixing unit 240 may be disposed on a printing medium conveyance path to fix an image into the printing medium P with heat and pressure. The fixing unit 240 may include a pair of fixing rollers 241 and 242 and a fixing frame 243, like the first exemplary embodiment explained above with reference to FIGS. 2 to 6.

The first fixing roller 241 may house a heating source 241*a* to heat the printing medium. The heating source 241*a*. The heating elements such as a halogen lamp may be implemented as the heating source 241 of the first fixing roller 141. The heating source 241*a* generates fixing heat approximately of 200° C.

The second fixing roller 242 may face the first fixing roller 241 and rotate to press the printing medium against the first fixing roller 241. To this purpose, one or more of the second fixing roller 242 may be elastically supported by pressing springs 242*a*.

While the first fixing roller 241 houses therein the heating source 241*a* to operate as a heating roller, and the second fixing roller 242 is supported by the pressing springs 242*a* to operate as a pressing roller in the second exemplary embodiment, one skilled in the art will understand that this should not be construed as limiting, but other alternatives are possible.

For example, both the first and second fixing rollers 241 and 242 may house therein heating sources 241*a* to operate either as the heating rollers, or alternatively, the first and second fixing rollers 241 and 242 may be supported by the pressing springs 242*a* to operate as the pressing rollers.

The fixing frame 243 rotatably supports the first and second fixing rollers 241 and 242. The fixing frame 243 may be made out of a low conductive material.

Figure 9:
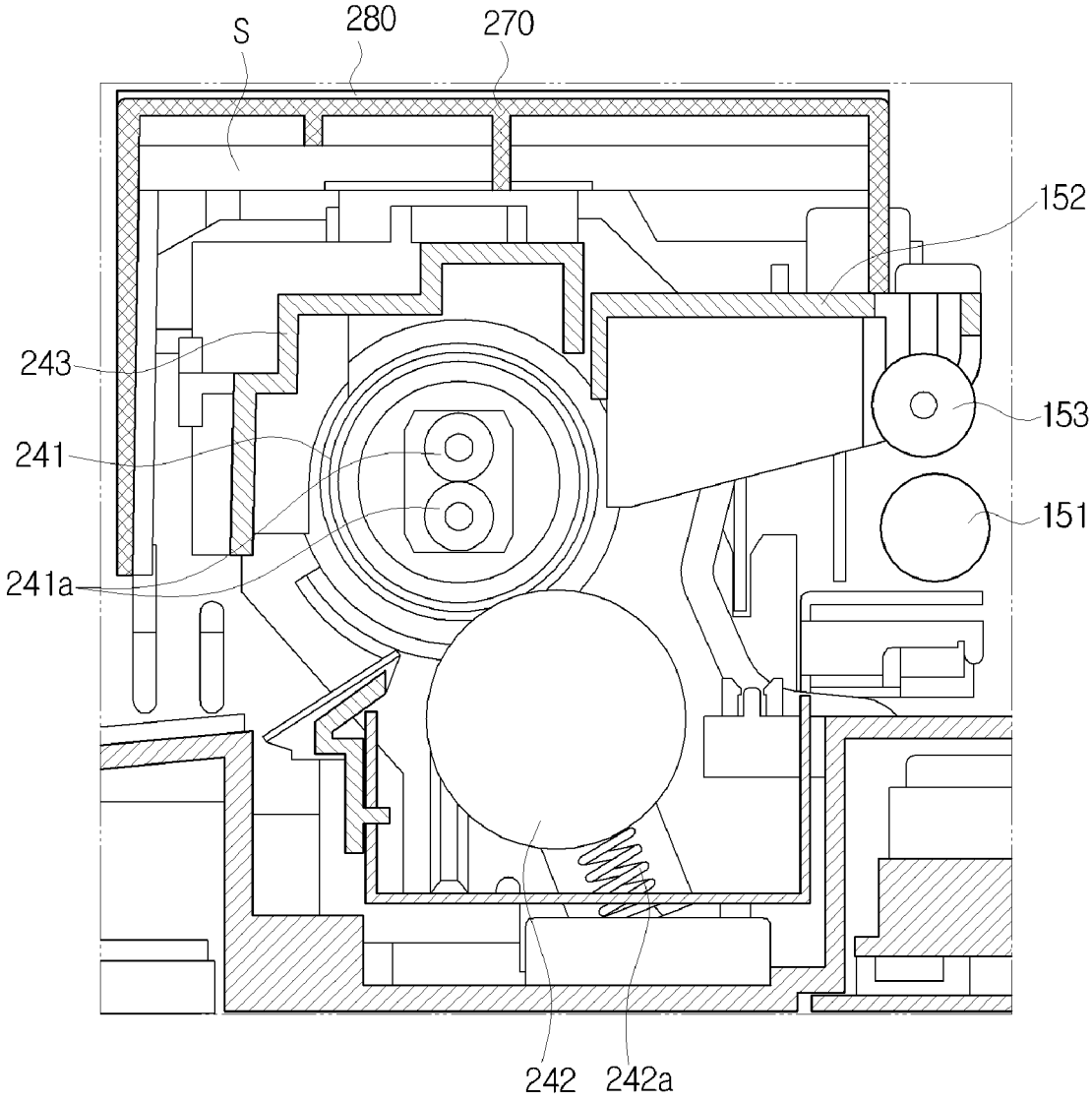
FIG. 9 is a cross section view taken on line IX-IX of FIG. 7.

Referring to FIG. 9, the fixing frame 243 may have a discharge guide 152 having an idle roller 153 that faces the discharge roller 151, like the second exemplary embodiment explained above with reference to FIGS. 2 to 6.

The cover 270 covers the fixing unit 240 and the discharge guide 152. The cover 270 covers the first fixing roller 241 that generates a fixing heat. The cover 270 initially prevents the fixing heat of the first fixing roller 241 from radiating outside. The fixing frame 243 and the cover 270 are distanced away from each other by a space (S) to initially prevent transmission of the fixing heat of the first fixing roller 241.

Figure 10:
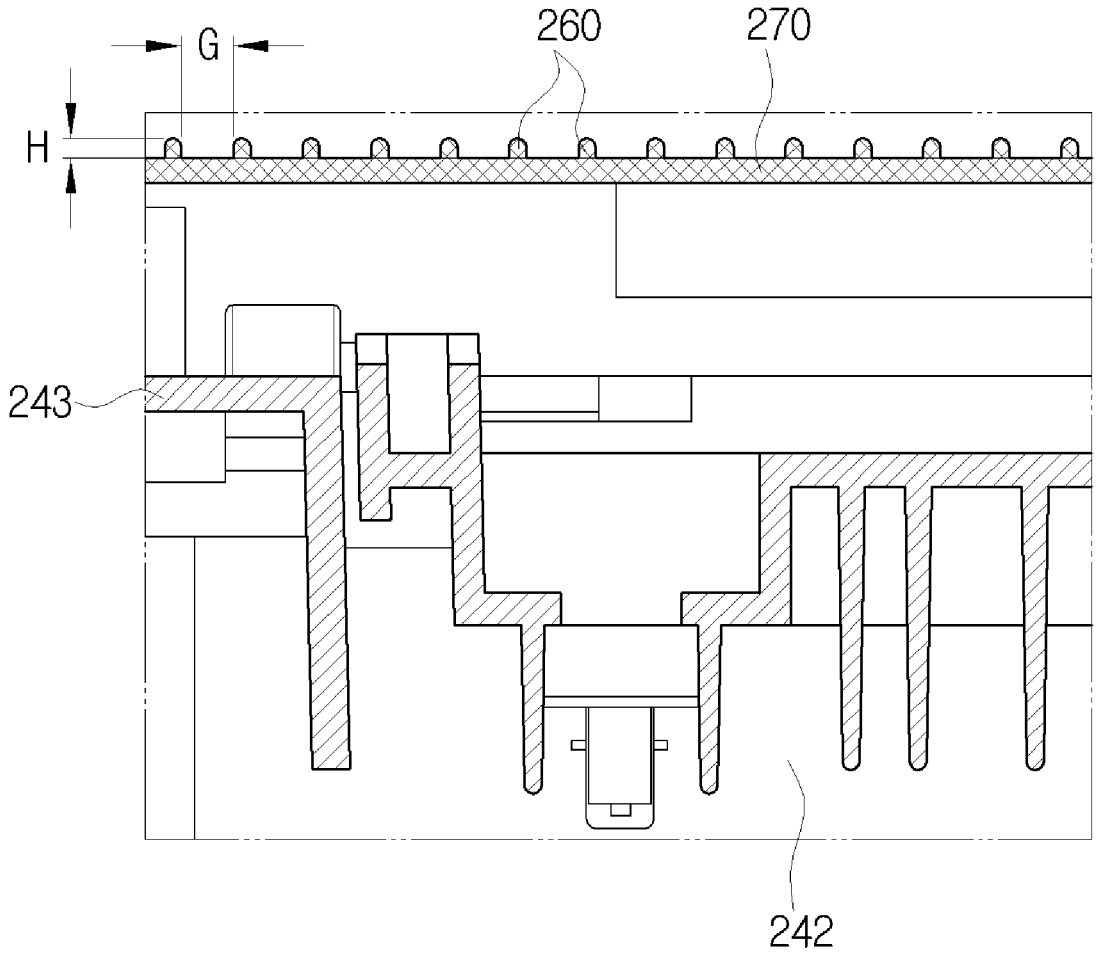
FIG. 10 is a view illustrating area B of FIG. 8 in enlargement.

Referring to FIG. 10, a plurality of heat dissipating ribs 280 are extended from an outer surface of the cover 270 to a predetermined height (H). The heat dissipating ribs 280 are spaced away from each other by a predetermined gap (G). The heat dissipating ribs 280 have the height H and also are placed at the gaps (G) from each other so as to prevent a user's hand from directly contacting the cover 270.

Figure 11A:
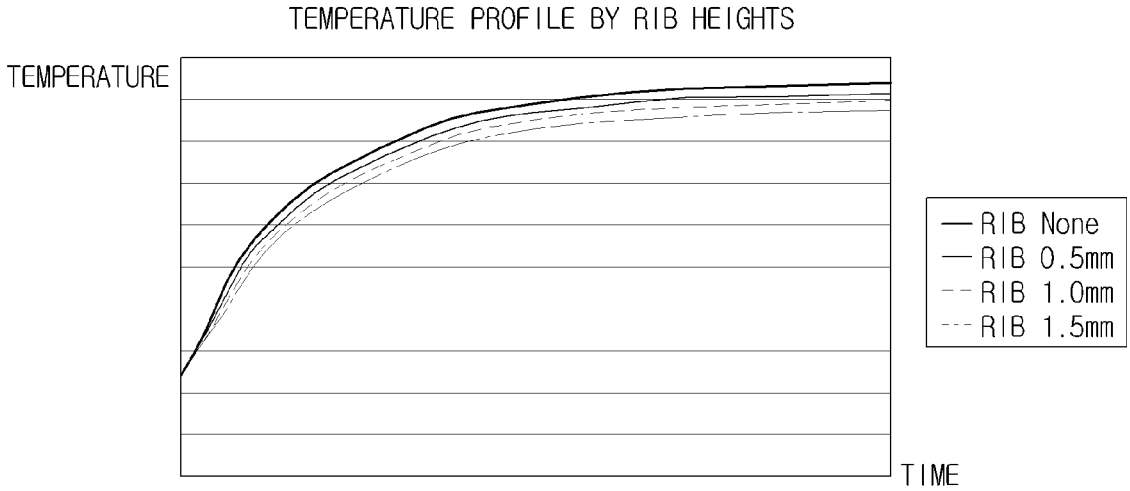
FIGS. 11A and 11B are graphical representations of temperature of radiating heat varying according to the heights of heat dissipating ribs.
Figure 11B:
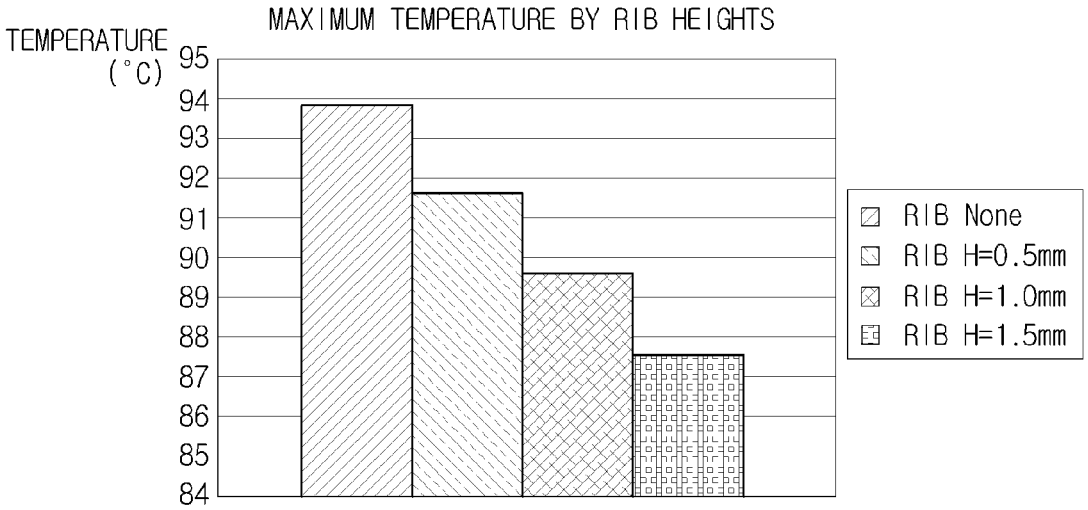

Referring to FIGS. 11A and 11B, the presence of the heat dissipating ribs 280 keeps the heat at a relatively lower temperature compared to when no heat dissipating ribs 280 are provided. If the heat dissipating ribs 280 are further extended, the better heat dissipation effect is provided.

The temperature difference may be kept at approximately 10° C. between the cover 270 and the heat dissipating ribs 280. The graphical representations of FIGS. 11A and 11B indicate the heat dissipating ribs 280 having approximately 1.0 mm of height provide a good effect. However, the height (H) of the heat dissipating ribs 280 is confined within a predetermined range so as not to interfere with the neighboring components.

The heat dissipating ribs 280 may be spaced away from each other approximately by 10 mm of gap (G), considering the average minimum width of a human finger.

An operation of an image forming apparatus according to the second exemplary embodiment of the present general inventive concept will be explained below with reference to FIGS. 7 to 10.

Referring to FIGS. 7 to 10, the first fixing roller 241 is heated by the heat source 241*a* housed therewithin, and the second fixing roller 242, supported by the pressing springs 242*a* at one or more ends, is pressed toward the first fixing roller 241. As a printing medium is passed between the first and second rollers 241 and 242, an image is fixed into the printing medium.

At this situation, the heat of the first fixing roller 241 is initially let out through the space (S) between the fixing frame 243 and the cover 270 and then secondly dissipated through the heat dissipating ribs 280. As a result, a surface of the cover 270 and the heat dissipating ribs 280 have approximately 10° C. or more of temperature difference.

Moreover, a user is protected from a potential burn as the heat dissipating ribs 280 are arranged at a gap (G) which is narrower than the width of a finger and thus the user is prevented from directly contacting a surface of the cover 270 during a removal of a jammed printing medium or other repairing process.

According to the exemplary embodiments of the present general inventive concept, by placing the guide protrusions 154 on the discharge guide 152 which is rotatable on the fixing frame 143, the guide protrusions 154 are able to guide the leading edge of the printing medium P when the printing medium P is passed through the fixing unit 140, and do not interfere with a jammed printing medium P. As a result, damage to the jammed printing medium P or the guide protrusions 154 is prevented.

Furthermore, a plurality of heat dissipating ribs 280 formed on an outer surface of the cover 270 of the fixing unit to distance other adjacent components from contacting the cover 270. As a result, deformation, malfunction, or damage of the adjacent components due to high heat is prevented.

Furthermore, because the plurality of heat dissipating ribs 280 have height (H) and gap (G) to prevent the direct contact of a user's hand to the cover 270, user safety increases without compromising user accessibility to the fixing unit.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a fixing unit having a fixing frame and a pair of fixing rollers rotatably disposed on the fixing frame to fix a toner image into a printing medium when the toner image is transferred onto the printing medium;

at least one discharge roller disposed on the fixing frame; and a discharge guide rotatably mounted on the fixing frame and movable in a vertical direction, the discharge guide comprising a plurality of guide protrusions to guide the printing medium towards the discharge roller when the printing medium is passed through the fixing unit.

2. The image forming apparatus of claim 1, wherein the discharge guide is movable between an opening position and a closing position, in which a discharge path of the printing medium is open at the opening position and closed at the closing position.

3. The image forming apparatus of claim 2, wherein the discharge guide pivots with respect to the fixing frame to open the fixing frame.

4. The image forming apparatus of claim 1, comprising an elastic element to elastically bias the guide protrusions toward the fixing roller.

5. The image forming apparatus of claim 4, comprising stoppers disposed on the discharge guide and at locations corresponding to the respective guide protrusions, to restraint a returning force of the elastic element.

6. The image forming apparatus of claim 3, wherein at least one idle roller is disposed on the discharge guide to rotate in contact with the discharge roller at a closing position.

7. The image forming apparatus of claim 1, wherein the discharge guide comprises a plurality of conveyance ribs formed on a rear surface thereof to face the a pair of fixing rollers.

8. The image forming apparatus of claim 1, further comprising a locking unit to selectively lock the discharge guide with respect to the fixing frame, wherein the locking unit is pulled up to unlock the discharge guide and is pushed down to lock the discharge guide.

9. The image forming apparatus of claim 8, wherein the locking unit comprises:

a locking protrusion disposed on the discharge guide, comprising a gradient, and movable between a locking and unlocking positions;

a hook disposed on the fixing frame, and comprising a gradient corresponding to the gradient of the locking protrusions such that the locking protrusion at the locking position is engaged with the hook; and a locking spring to elastically bias the locking protrusion towards the locking position.

10. The image forming apparatus of claim 9, wherein the locking unit comprises:

a movable protrusion integrally extending from the locking protrusion; and a locking rail to receive the movable protrusion, and to guide the movement of the movable protrusion.

11. The image forming apparatus of claim 1, wherein the fixing unit further comprises:

a cover to cover the at least one discharge roller and the discharge guide; and a plurality of heat dissipating ribs extending from an outer surface of the cover, wherein the plurality of heat dissipating ribs have a height of 1.0 mm or more and a gap of 10 mm or less to prevent a user's hand from directly contacting the cover.

12. An image forming apparatus comprising a discharge guide rotatably mounted on a fixing unit that fixes a visible image into a printing medium with a heat, the discharge guide comprising:

a discharge guide body;

a hinge formed on two portions of one side of the discharge guide body as a pivot of vertical movement; and a handgrip portion formed approximately on a center of an opposite side to the side where the hinge is formed, wherein the discharge guide body has different a heat conductivity between a proximity to the handgrip portion and other areas.

13. The image forming apparatus of claim 12, wherein the discharge guide body comprises a plurality of guide protrusions to guide conveyance of the printing medium.

14. The image forming apparatus of claim 13, wherein the handgrip portion is made out of a material having a heat conductivity different from the discharge guide body, and attached to the discharge guide body.

15. The image forming apparatus of claim 12, wherein the fixing unit comprises a plurality of heat dissipating ribs extending from an outer side thereof to a height of 1 mm or more and arranged at a gap of 10 mm or less from each other.

16. An image forming apparatus comprising:

a fixing unit to fix a transferred image into a printing medium;

a discharge guide rotatably disposed on the fixing unit to cover the fixing unit, and having a plurality of guide protrusions to guide the printing medium, toward a discharge roller;

a cover to cover the fixing unit and the discharge guide; and a plurality of heat dissipating ribs extending from an outer surface of the cover to a height and arranged at a gap from each other to block a user's hand from directly contacting the cover, wherein the discharge guide is movable in a vertical direction.

17. The image forming apparatus of claim 16, wherein the height is 1.00 mm or more, and the gap is 10 mm or less.

18. The image forming apparatus of claim 17, wherein the fixing unit comprises:

a pair of fixing rollers to generate a fixing heat; and a fixing frame to support the pair of fixing rollers and the discharge roller, wherein the cover is disposed on the fixing frame to cover the proximity to one of the pair of fixing rollers that generates the fixing heat.

19. The image forming apparatus of claim 18, wherein the fixing frame and the cover are distanced away from each other by a space to prevent a heat transmission.

20. The image forming apparatus of claim 19, wherein the discharge guide is engaged to the fixing frame by a hinge to be moved between an open position to open a discharge path of the printing medium and a close position to close the discharge path of the printing medium.

21. An image forming apparatus comprising:

a fixing unit having a main fixing frame and one or more fixing rollers rotatably disposed on the main fixing frame to fix a toner image into a printing medium when the toner image is transferred onto the printing medium; and a sub frame rotatably mounted on the main fixing frame and movable in a vertical direction, and having a discharge guide and one or more guide protrusions to guide the printing medium to be discharged from the fixing unit.

22. The image forming apparatus of claim 21, wherein:

the sub frame moves from the main fixing frame between a closed position and an open position; and the discharge guide and the one or more guide protrusions are disposed close to the fixing unit in the closed position to guide the printing medium from the fixing unit to an outside thereof, and disposed away from the fixing unit in the open position to provide a space between the fixing unit and the discharge guide and the discharge guide protrusions to remove the printing medium when the printing medium is jammed.

23. The image forming apparatus of claim 21, wherein:

the sub frame moves from the main fixing frame between a closed position and an open position; and the discharge guide and the one or more guide protrusions have a first distance with the fixing unit the closed position to guide the printing medium from the fixing unit to an outside thereof, and a second distance with the fixing unit in the open position to provide a space between the fixing unit and the discharge guide and the discharge guide protrusions to remove the printing medium.

* * * * *